US005282592A

United States Patent [19]

Ma

[11] Patent Number: 5,282,592

[45] Date of Patent: Feb. 1, 1994

[54] PORTABLE AND COLLAPSIBLE VESSEL HOLDER

[76] Inventor: Mark Ma, 1415 Martens Dr., Hammond, La. 70401

[21] Appl. No.: 979,605

[22] Filed: Nov. 20, 1992

[51] Int. Cl.[5] ..... A47G 23/02

[52] U.S. Cl. ..... 248/150; 220/495; 224/42.45 R; 248/311.2

[58] Field of Search ..... 248/146, 150, 153, 311.2, 248/310; 220/495; 224/42.45 P, 42.46 R; 108/26; 297/194

[56] References Cited

U.S. PATENT DOCUMENTS

| | | | |
|---|---|---|---|
| 166,346 | 8/1875 | Collier | 248/153 |
| 299,844 | 6/1884 | Paine | 220/495 X |
| 1,402,620 | 1/1922 | Kibbe | 248/150 |
| 3,315,835 | 4/1967 | Katzman | 220/495 X |
| 4,573,653 | 3/1986 | Boettger | 248/311.2 X |
| 4,813,582 | 3/1989 | Henricksen | 224/42.46 R X |
| 4,967,988 | 11/1990 | Nguyen | 248/150 |

FOREIGN PATENT DOCUMENTS

| | | | |
|---|---|---|---|
| 410241 | 5/1934 | United Kingdom | 211/153 |

*Primary Examiner*—J. Franklin Foss

*Attorney, Agent, or Firm*—Pravel, Hewitt, Kimball & Krieger

[57] ABSTRACT

A vessel holder for cups or the like, having a generally square or rectangular base portion for positioning on a flat surface such as the dashboard or a seat, a plurality of side members positionable from a storage position substantially horizontal against the upper face of the base, and movable to a substantially vertical position wherein a cup or a bottle may be placed within the space defined by the four upright members. It is further included a wire border which is a generally rectangular portion of wire positionable as a continuous border around the upper portions of the upright sides, in order to define a substantially continuous member in order to hold the side members in an upright position. Further, one of the ends of the upper border is somewhat truncated in order to define an opening in the sidewall so that a handle on the cup may extend therefrom. Further, each of the sides are defined by a continuous wire member including a means for inserting a portion of the upper border between the wire members in order to define the continuous sidewall.

3 Claims, 3 Drawing Sheets

PORTABLE AND COLLAPSIBLE VESSEL HOLDER

BACKGROUND OF THE INVENTION

1. Field Of The Invention:

The present invention relates to drinking vessels. More particularly, the present invention relates to a holder for a drinking vessel which is portable and includes a plurality of collapsible sides for serving as a vessel holder while the sides are in the upright position and can be stored in a confined area due to the collapsibility of the walls.

2. General Background

In the area of vessel holders, it has become quite common in vehicles and the like for modern day vehicles to include holders for cups, bottles or the like. In most instances, the holders are contained within a divider between car seats, or a holder which may extend outward from the dashboard of the automobile.

In addition, there are holders which may be placed upon the dashboard or the like, having a velcro sticking surface, in order to hold the vessel. These types of holders are quite common, but have the drawback in that they cannot be stored when not in use. For example, it would be useful in the art if there were a vessel holder which would have the ability to be stored within a confined space such as the glove compartment of the automobile, while not in use, would be able to be easily and efficiently assembled and placed on a dashboard or the seat next to the driver for use when needed.

SUMMARY OF THE PRESENT INVENTION

The apparatus of the present invention solves the shortcomings of the art in a simple and straightforward manner. What is provided is a vessel holder for cups or the like, having a generally square or rectangular base portion for positioning on a flat surface such as the dashboard or a seat, a plurality of side members positionable from a storage position substantially horizontal against the upper face of the base, and movable to a substantially vertical position wherein a cup or a bottle may be placed within the space defined by the four upright members. There is further included a means, which is a generally rectangular portion of wire positionable as a continuous border around the upper portions of the upright sides, in order to define a substantially continuous member to hold the side members in an upright position. Further, one of the ends of the upper border is somewhat truncated in order to define an opening in the sidewall so that a handle on the cup may extend therefrom. Further, each of the sides are defined by a continuous wire member including a means for inserting a portion of the upper border among the wire members in order to define the continuous sidewall.

Therefore, it is a principal object of the present invention to provide a vessel holder having a plurality of side members which are movable from a first horizontal storage position to a second upright vessel holder position;

It is a further object of the present invention to provide a vessel holder, which enables the side members to be placed in the collapsed down position so that the vessel holder occupies a very small area and may be placed within a confined space for storage such as a glove compartment;

It is a further object of the present invention to provide a cup or vessel holder which may be configured from a first storage position with the side walls in the substantially horizontal position, to a second vessel holder position with the side walls in the vertical position very quickly and efficiently.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
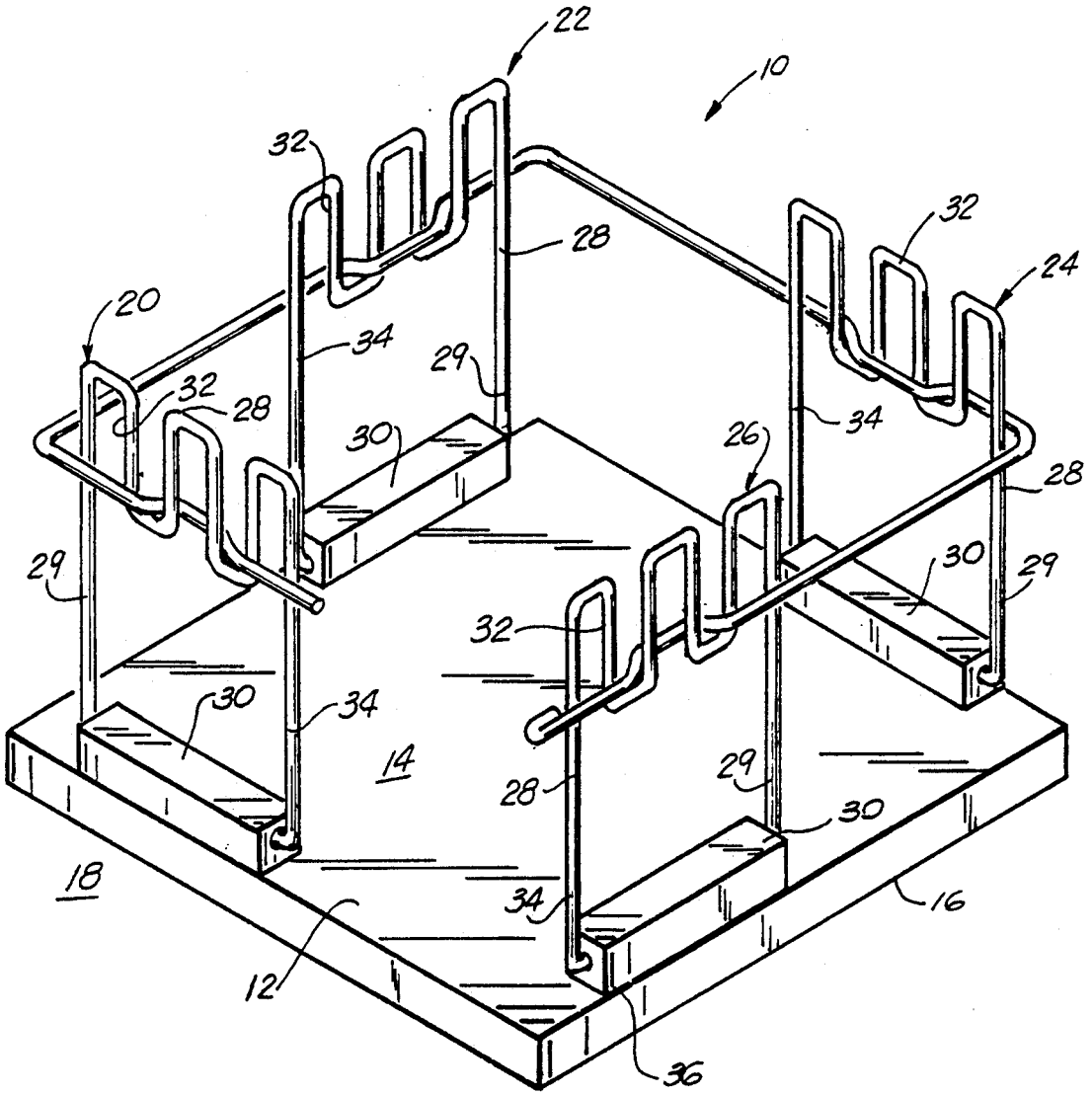
FIG. 1 illustrates an overall perspective view of the preferred embodiment of the apparatus of the present invention.

FIGS. 1–5 illustrate the preferred embodiment of the apparatus of the present invention by the numeral 10. As seen in FIG. 1, apparatus 10 would comprise a substantially square or rectangular base portion 12, having an upper face 14, and a lower face 16, with the lower face 16, positionable on a flat surface 18 such as a dashboard or the seat of a vehicle. As illustrated, base portion 12 further includes extending upward in the vertical position therefrom, a plurality of what could be defined as sidewalls 20, 22, 24 and 26, each of the sidewalls further comprising a continuous wire member 28, having a first upright leg 29 positioned within a base member 30, with the upright leg 29, forming a plurality of loops 32 along the upper portion and extending into a second downwardly depending leg 34, also positioned with the base member 30. Such a base member 30 is positioned on each edge 36 of the rectangular base portion 12, so as to define the four upright wall members 20, 22, 24, and 26, positioned within each of the base members 30.

Figure 2:
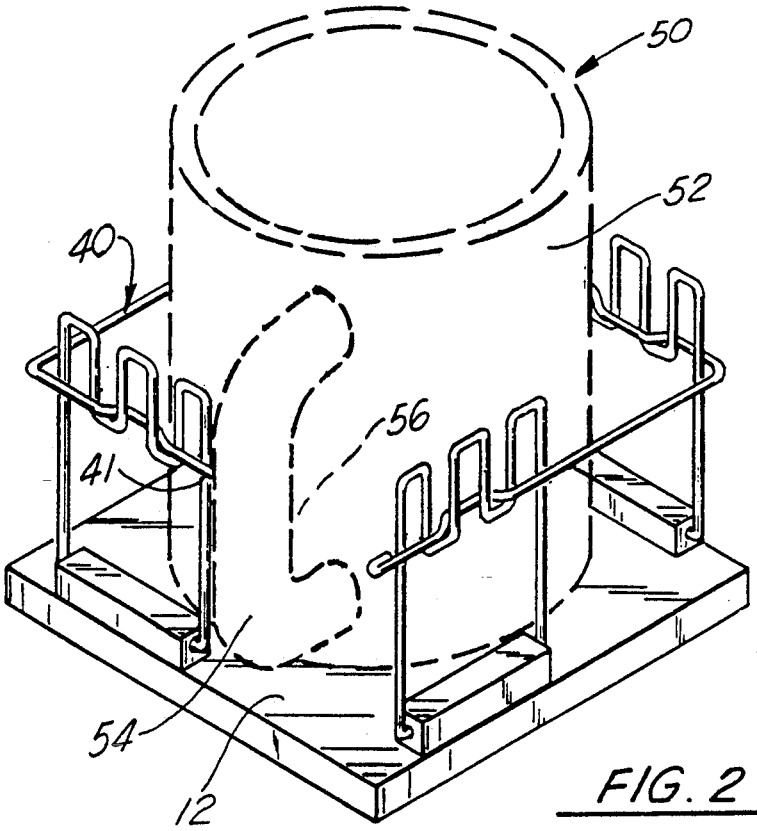
FIG. 2 illustrates an overall view of the preferred embodiment of the apparatus of the present invention with a cup position therein.
Figure 4:
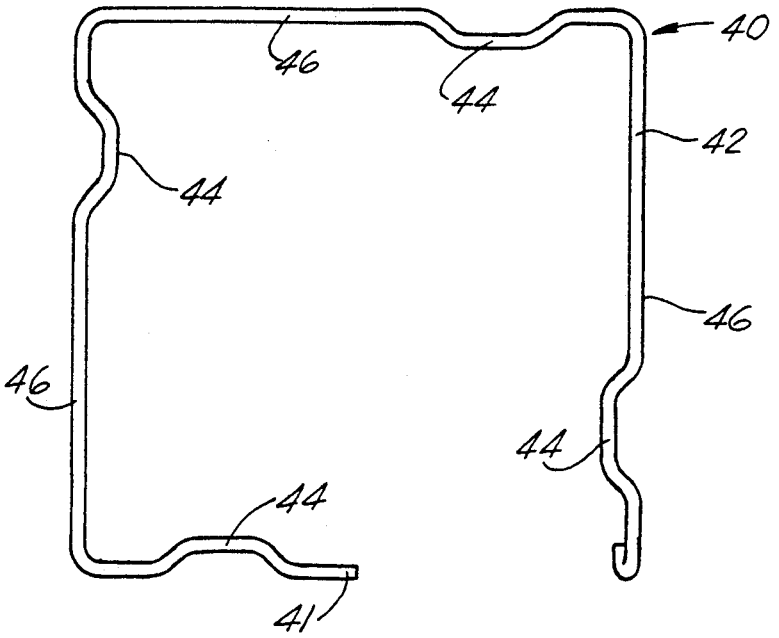
FIG. 4 illustrates an overall view of the wire border member of the apparatus of the present invention.

As illustrated in FIGS. 1 and 4, there is further provided a substantially continuous upper border member 40, which comprises a substantially continuous wire member 42, with the wire member 42 having an indented portion 44 along each side 4 which would thread through one of the upright loops 32 of each of the sidewalls so that the wire member could be placed downward onto each of the upright wall members as illustrated in FIG. 1, for maintaining each of the side members in the upright position, and at the same time serving as a means for maintaining a vessel 50 or the like in the holder 10 as illustrated in FIG. 2.

Turning now to FIG. 2, there is illustrated the vessel 50, having a fluid container portion 52, and a handle portion 54. As illustrated, handle portion 54 extended outward from the vessel portion 52, would likewise extend outward over the edge of the base portion 12. That being the case, one of the arms of the border member 40, would be somewhat truncated as seen in FIGS. 1 and 2, and defining a space 56 between the truncated end 41 of one of the sides 46 of member 40, and the adjacent sidewall. This space 56 would accommodate the handle portion 54 of the vessel member 50, so that it may protrude out from the overall rectangular base. It is in this position that the apparatus is serving to contain the vessel 50, and may be positioned on the seat or the dashboard through the use of velcro or the like on its lower face 16.

Figure 3:
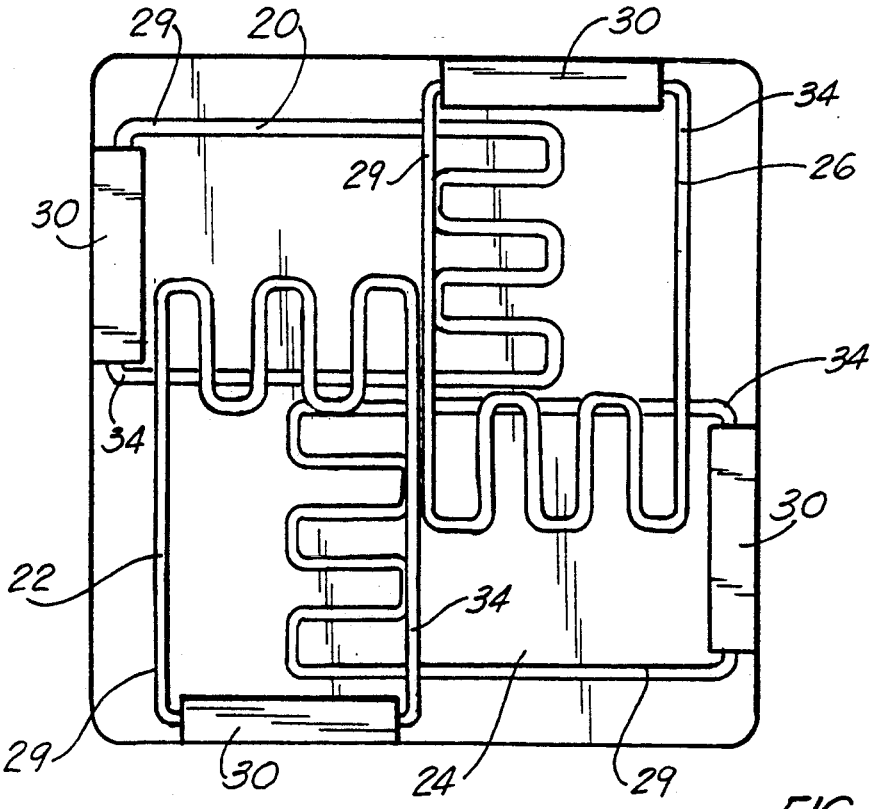
FIG. 3 illustrates a top view of the preferred embodiment of the apparatus invention with the side walls in the down horizontal position.

Turning now to FIG. 3, there is illustrated the four sidewall members 20, 22, 24 and 26, in the substantially horizontal position and folded downward onto the base portion 12, with each of the side walls laying upon one another to defind a substantially flat surface. As illustrated, the leg members 29, 34 of each of the sidewall portions, rotate within each of the base members 30, from the first upright position as seen in FIGS. 1 and 2, to the lower storage position as seen in FIG. 3. In order to accomplish this as illustrated, the upright border member 40 is removed from in position around the four sidewalls and is slid upward out of each of the grooves formed by the loop members 32. When this is done, each of the side portions fold downwardly and into the storage position as seen in FIG. 3. When it is in this position, the apparatus is able to be stored within the glove compartment or the like.

Figure 5:
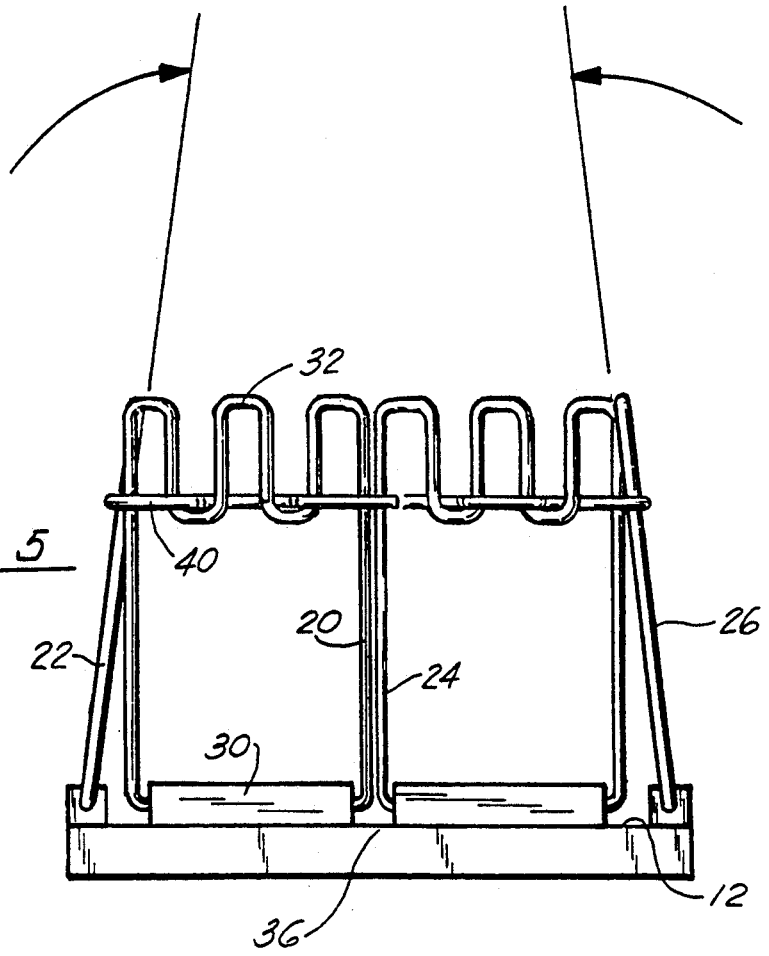
FIG. 5 illustrates a side view of the apparatus of the present invention in the configured state with the wire members positioned upon the side walls.

As illustrated in FIG. 5, each of the sidewalls 20, 22, 24, 26 are slanted slightly inward from their base, so as to accomodate the width of a vessel 50 therein. In this fashion, should a smaller vessel need to be accomodated, a smaller border member 40 could be utilized, which would draw the upper ends of the walls further inward to allow a closer opening for the smaller vessel, thus reducing movement of a smaller vessel within the space defined by the border member.

In utilization of this invention, it therefore becomes quite easy for a user to manually position the four wall members 20, 22, 24 and 26 upright, and to slide the wire border 40 around the four wall members as is illustrated in FIGS. 4 and 5 in order to form the final configured product as illustrated in FIGS. 1 and 2.

The following table lists the part numbers and part descriptions as used herein and in the drawings attached hereto.

| | |
|---|---|
| apparatus | 10 |
| base portion | 12 |
| upper face | 14 |
| lower face | 16 |
| base member | 30 |
| sidewalls | 20, 22, 24, 26 |
| upright leg | 29 |
| loop | 32 |
| depending leg | 34 |
| edge | 36 |
| continuous upper border member | 40 |
| truncated end | 41 |
| continuous wire member | 42 |
| indented portion | 44 |
| side | 46 |
| vessel | 50 |
| fluid container portion | 52 |
| handle portion | 54 |

-continued

| | |
|---|---|
| space | 56 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for supporting a vessel such as a cup or the like, comprising:

a) a substantially flat base portion;

b) a plurality of wire wall members movable from a first horizontal position on the base portion, to a second upright position for defining a vessel storage space therein;

c) an upper border member slidably engagable around the four side members for defining a means to maintain the four side members in the upright position when a vessel is placed therein; and d) means, along at least one of the side members for defining a space for accommodating a handle of a vessel placed therein, wherein each of the side members comprises a substantially continuous wire member forming a plurality of loops on its upper region and hingably movable from a down to an up position.

2. An apparatus for supporting a vessel such as a cup or the like, comprising:

a) a substantially flat base portion;

b) a plurality of wall members movable from a first horizontal position on the base portion, to a second upright position for defining a vessel storage space therein;

c) an upper border member slidably engagable around the four side members for defining a means to maintain the four side members in the upright position when a vessel is placed therein; and d) means along at least one of the side members for defining a space for accommodating a handle of a vessel placed therein, wherein the means for maintaining each of the sidewalls upright further comprises a wire member threadably engagable through a loop in each of the side members, for defining a continuous upper border and maintaining each of the side members in the up position.

3. An apparatus for supporting a vessel such as a cup or the like, comprising:

a) a substantially flat base portion;

b) a plurality of wire wall members movable from a first horizontal position on the base portion, to a second upright position for defining a vessel storage space therein, each of the wire members further comprising a means to accomodate an upper border wire member;

c) an upper border wire member slidably engagable around the four side members for defining a means to maintain the four side members in the upright position when a vessel is placed therein; and d) means, along at least one of the side members for defining a space for accommodating a handle of a vessel placed therein.

* * * * *